US008584873B2

(12) United States Patent
Horn et al.

(10) Patent No.: US 8,584,873 B2
(45) Date of Patent: Nov. 19, 2013

(54) MODULAR RACKING SYSTEM

(75) Inventors: Brett Horn, Durban (ZA); Erika Gomez, Atlanta, GA (US)

(73) Assignee: The Coca-Cola Company, Atlanta, GA (US)

( * ) Notice: Subject to any disclaimer, the term of this patent is extended or adjusted under 35 U.S.C. 154(b) by 306 days.

(21) Appl. No.: 12/850,687

(22) Filed: Aug. 5, 2010

(65) Prior Publication Data

US 2012/0031863 A1 Feb. 9, 2012

(51) Int. Cl.
*A47B 47/00* (2006.01)

(52) U.S. Cl.
USPC ..... 211/187; 211/190

(58) Field of Classification Search
USPC ..... 211/187, 195, 153, 186, 188–190; 108/147.12, 147.15, 107
See application file for complete search history.

(56) References Cited

U.S. PATENT DOCUMENTS 1,952,111 A * 3/1934 Bales ..... 108/107
2,999,599 A 9/1961 Jentzen
4,201,139 A * 5/1980 Suttles ..... 108/109
4,553,725 A * 11/1985 Vargo ..... 248/221.11
4,865,402 A * 9/1989 Walter ..... 312/140
4,940,150 A 7/1990 Spengler
5,848,711 A * 12/1998 Schmit ..... 211/90.04
5,913,270 A * 6/1999 Price ..... 108/101
6,062,402 A 5/2000 Ford
6,220,464 B1 * 4/2001 Battaglia et al. ..... 211/187
6,286,694 B1 * 9/2001 Battaglia et al. ..... 211/187
6,315,136 B1 11/2001 Baldoni et al.
7,100,780 B1 * 9/2006 VanCalbergh et al. .... 211/94.01
2005/0173362 A1 8/2005 Squitieri et al.
2007/0210024 A1 * 9/2007 Haake ..... 211/149
2008/0000852 A1 * 1/2008 Primiano ..... 211/59.2
2009/0308084 A1 12/2009 Kreutzer et al.

* cited by examiner

*Primary Examiner* — Korie H Chan

(74) *Attorney, Agent, or Firm* — Sutherland Asbill & Brennan LLP

(57) ABSTRACT

The present application provides a modular racking system for use with a number of products. The modular racking system may include a number of support members and a number of shelves. The shelves may include a number of locking sections with a tapered cutout sized for one of the support members.

14 Claims, 6 Drawing Sheets

MODULAR RACKING SYSTEM

TECHNICAL FIELD

The present application relates generally to modular racking systems with a number of product shelves therein and more particularly relates to a modular racking system with a number of product shelves having locking sections with tapered cut outs therein for improved rigidity.

BACKGROUND OF THE INVENTION

Various types of modular racking systems are known. By way of example, these modular racking systems generally may include modular wall band systems with support rails mounted onto a wall or other structure and having replaceable shelves positioned on support brackets. Further, various types of freestanding modular racking systems also are known. These freestanding systems generally use some sort of corner locking mechanisms to maintain each shelf in place. These corner locking mechanisms, however, tend to be somewhat complicated such that the shelves may not be easily reconfigured.

There is thus a desire for an improved modular racking system that may be freestanding but without the complicated locking mechanisms usually found in such systems. Rather, such an improved modular racking system would provide the ease of use generally found in typical wall band systems but with adequate support and overall rigidity.

SUMMARY OF THE INVENTION

The present application thus provides a modular racking system for use with a number of products. The modular racking system may include a number of support members and a number of shelves. The shelves may include a number of locking sections with a tapered cutout sized for one of the support members.

The support members may be made out of extended upright tubing. The support members may include a number of slots therein. The support members may include a number of adjustable feet. The number of locking sections may include a number of front locking sections and a number of rear locking sections. The locking sections may include a support bracket extending into the tapered cutout and a number of teeth. Each of the shelves may include a front panel positioned adjacent to the locking sections with a tapered cutout. The front panel may include messaging indicia thereon. The modular racking system further may include one or more advertising panels positioned thereon.

The present application further may provide a modular racking system for use with a number of products. The modular racking system may include a number of support tubes with slots therein and a number of shelves. The shelves may include a number of front locking sections with a tapered cutout sized for one of the support tubes. The front locking sections may include a support bracket extending into the tapered cutout to mate with one of the slots.

The support bracket may include a number of teeth sized to mate with the slots. Each of the shelves may include a front panel positioned adjacent to the number of locking sections with a tapered cutout. The front panel may include messaging indicia thereon.

The present application may provide for a product display system for a number of products. The product display system may include a number of modular racking systems and a number of advertising panels positioned about the modular racking systems. The modular racking systems may include a number of support members and a number of shelves with a tapered cutout sized for one of the number of support members to be positioned therein.

The product display system further may include one or more coolers positioned adjacent to the modular racking systems. The advertising panels may include messaging indicia thereon. The shelves with a tapered cutout may include a support bracket extending therein to mate with the number of support brackets. The product display system further may include a number of front panels, a number of side panels, and a number of footer panels with messaging indicia thereon.

These and other features and improvements of the present application will become apparent to one of ordinary skill in the art upon review of the following detailed description when taken in conjunction with the several drawings and the appended claims.

DETAILED DESCRIPTION

Figure 1:
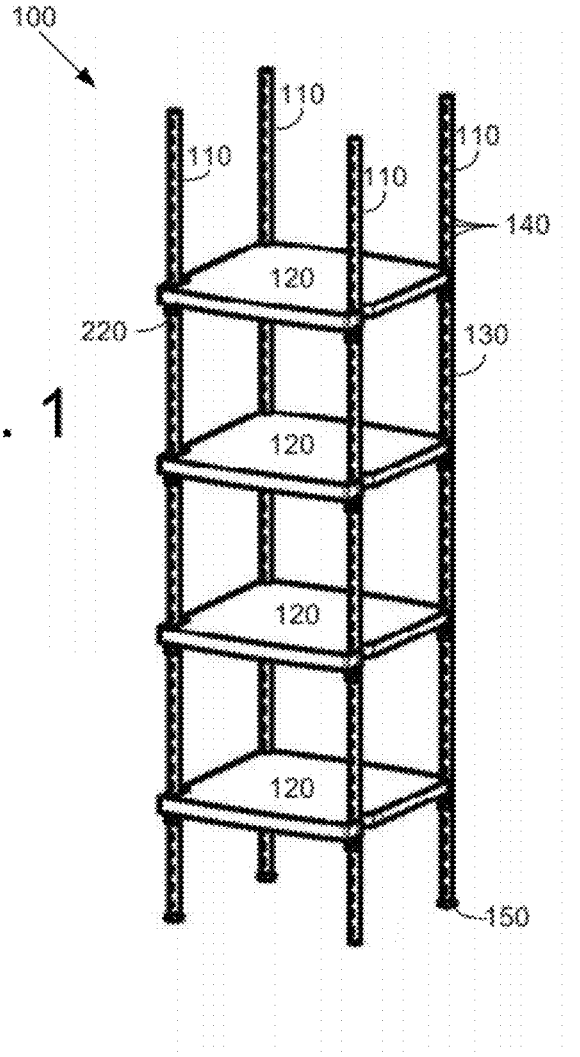
FIG. 1 is a front perspective view of a modular racking system as is described herein.
Figure 2:
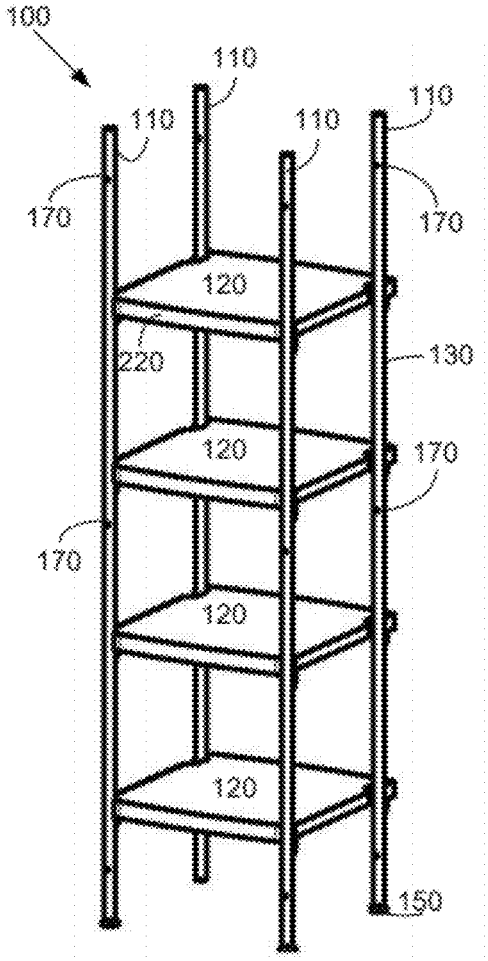
FIG. 2 is a rear perspective view of the modular racking system of FIG. 1.
Figure 3:
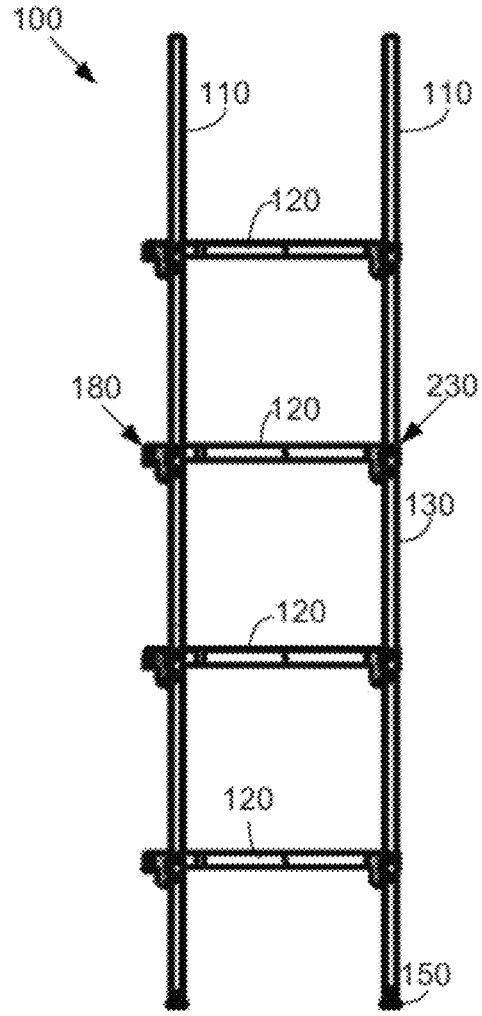
FIG. 3 is a side plan view of the modular racking system of FIG. 1.
Figure 4:
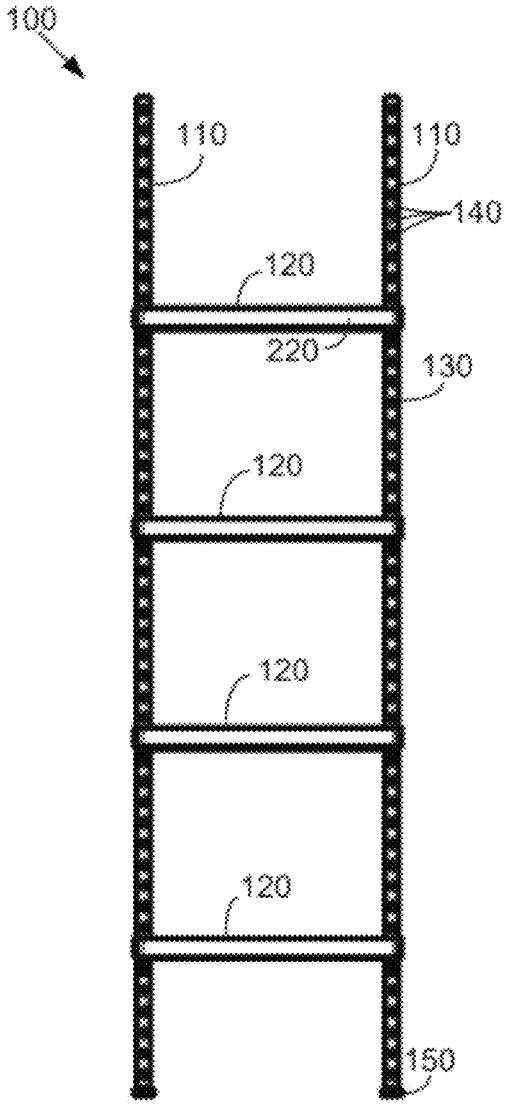
FIG. 4 is a front plan view of the modular racking system of FIG. 1
Figure 5:
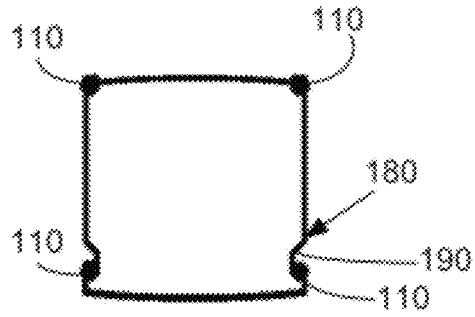
FIG. 5 is a top plan view of the modular racking system of FIG. 1.
Figure 6:
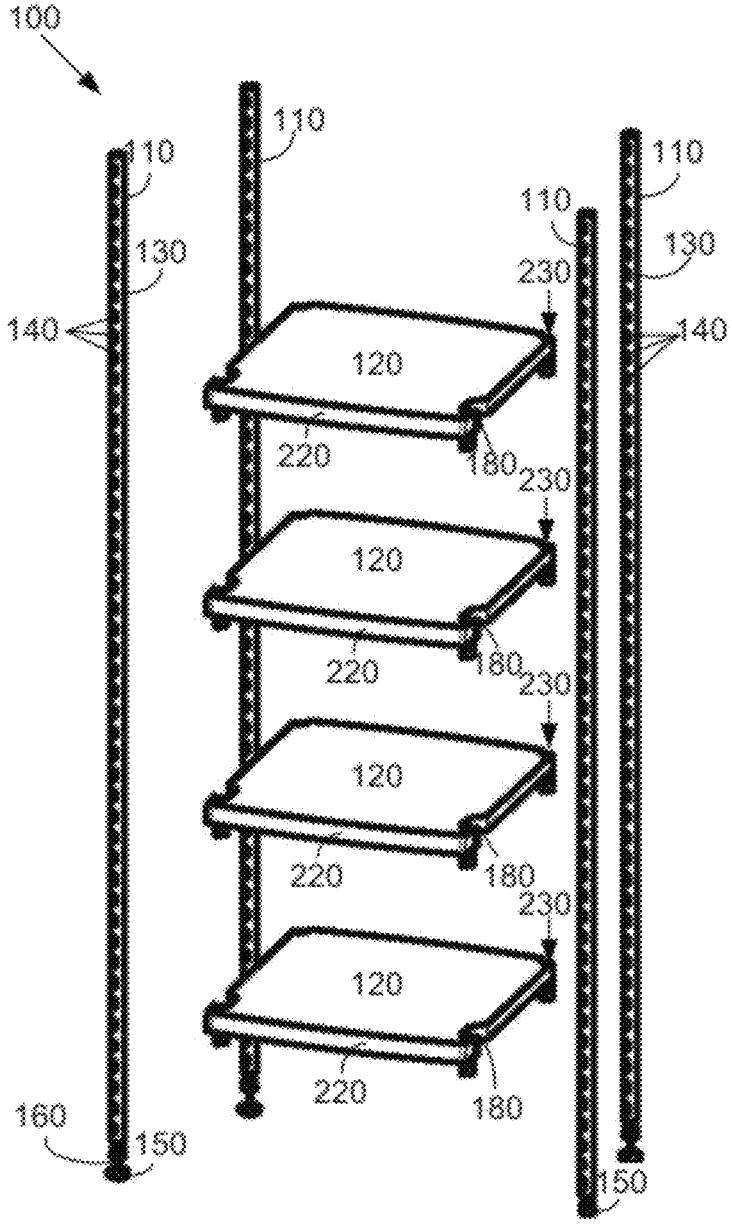
FIG. 6 is an exploded view of the modular racking system of FIG. 1.

The present application concerns the offering for sale of any number of products 10. Although the products 10 are shown, by way of example only, in the form of bottles, it is understood that the products 10 may include any type or size of item or package including, but not limited to, bottles, cans, pouches, boxes, wrapped items, produce, and/or any type of rigid or flexible packaging. The products 10 may include beverages, food items, non-food items, consumer products, and/or any type of product. The scope of this application is in no way limited by the nature of the products 10 intended to be offered herein or otherwise.

Referring now to the drawings, in which like numerals refer to like elements throughout the several views, FIGS. 1-6 show an example of a modular racking system 100 as may be described herein. The modular racking system 100 described herein may include a number of support members 110 and a number of shelves 120. Any number of the support members 110 and the shelves 120 may be used herein. Likewise, any size, shape, or configuration of the support members 110 and the shelves 120 may be used herein.

In this example, the use of four (4) support members 110 is shown such that one of the support members 110 is positioned about each corner of each of the shelves 120. Other positions may be used herein. The support members 110 may take the form of extended upright tubing 130. Other shapes and configurations may be used herein. The extended upright tubing 130 may be made out of metal, thermoplastics, or other types of substantially rigid materials. Specifically, the support members 110 may take the form of plastic transparent tubing 130. The support members 110 may have a number of slots 140 positioned along one or more sides thereof. Any number, size, or shape of the slots 140 may be used herein.

Each of the support members 110 may include an adjustable foot 150 positioned at one end thereof. The adjustable foot 150 may include a screw like member 160 extending into the support member 110 so as to adjust the height of the support member 110. Other types of adjustment mechanisms may be used herein. One or more sides of the support member 110 also may have a one or more screw holes 170 positioned therein. The screw holes 170 may be used with advertising panels and the like as will be described in more detail below. Other configurations of the support members 110 also may be used herein.

The shelves 120 may be positioned into any desired location along the support members 110. The shelves 120 may be made out of metal, thermoplastics, or any type of substantially rigid material. Multiple shelf configurations may be used herein. The shelves 120 may have a depth thereto and may be at least partially hollow. Other shapes may be used herein.

Figure 7:
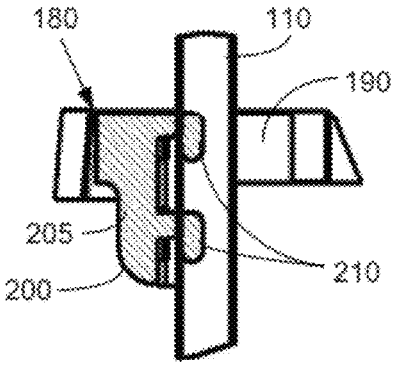
FIG. 7 is a partial side cross-sectional view of front locking section for use in the modular racking system of FIG. 1.
Figure 9:
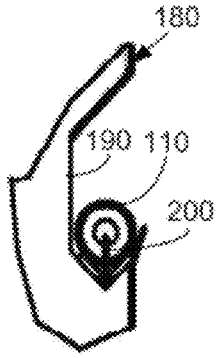
FIG. 9 is a partial top plan view of the front locking section of FIG. 7.
Figure 8:
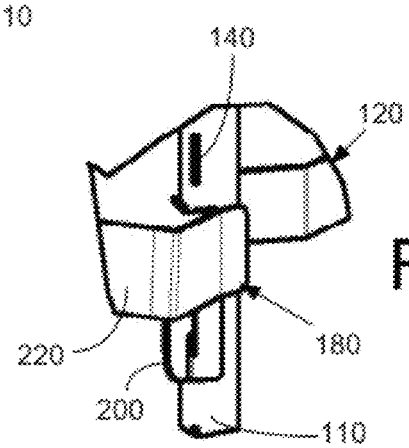
FIG. 8 is a partial side perspective view of the front locking section of FIG. 7.
Figure 10:
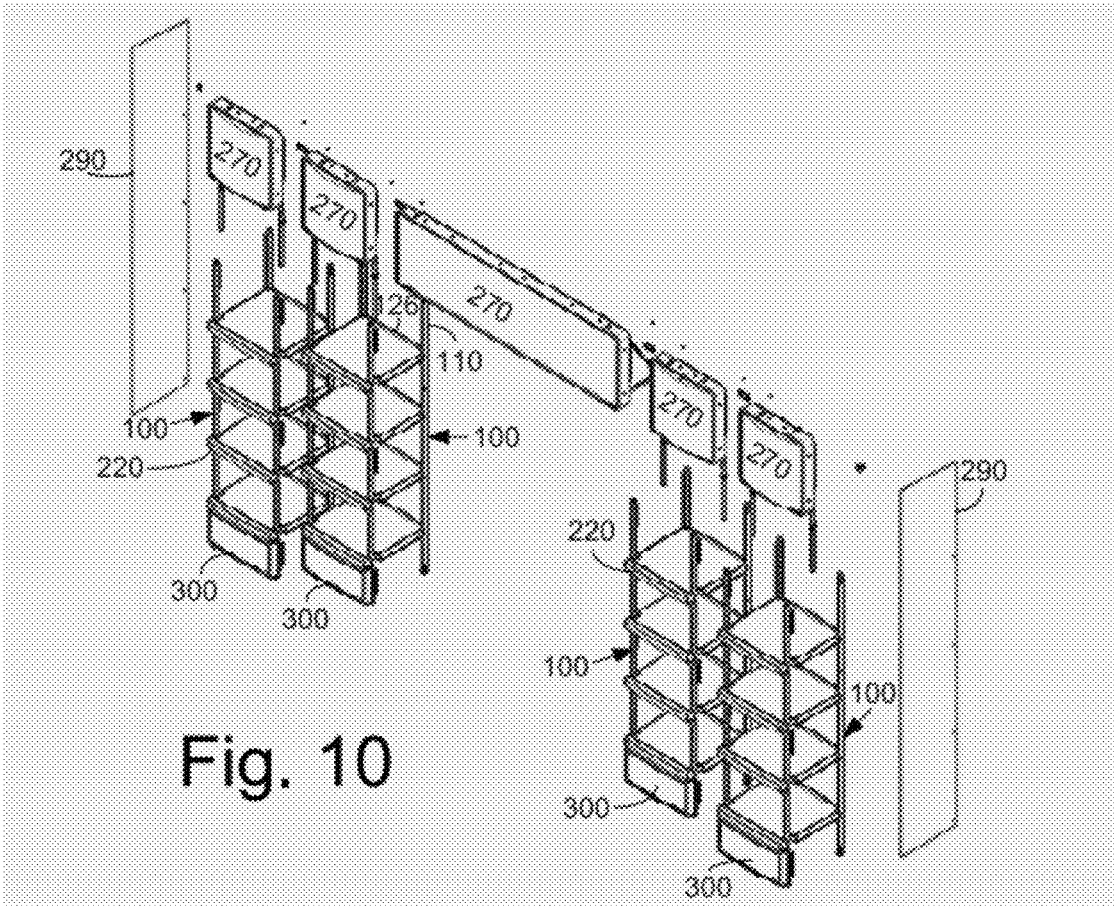
FIG. 10 is an exploded view of a modular product display system using a number of modular racking systems therein.
Figure 12:
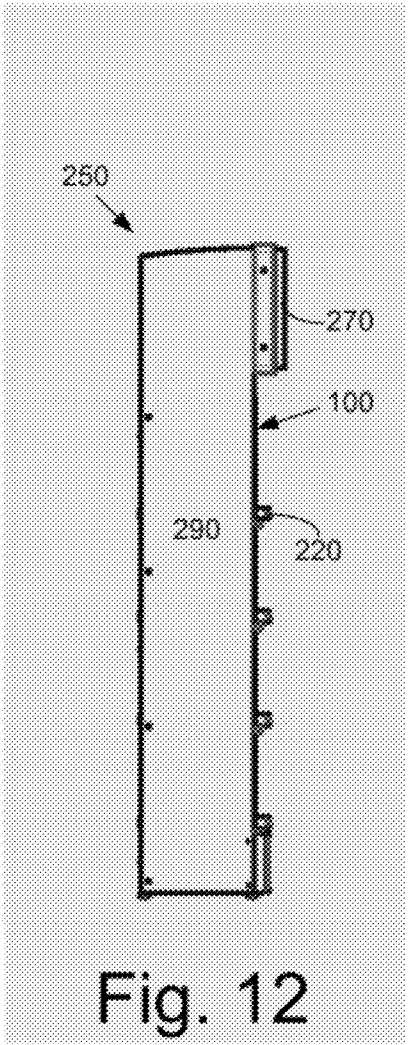
FIG. 12 is a side plan view of the modular product display system of FIG. 10.
Figure 11:
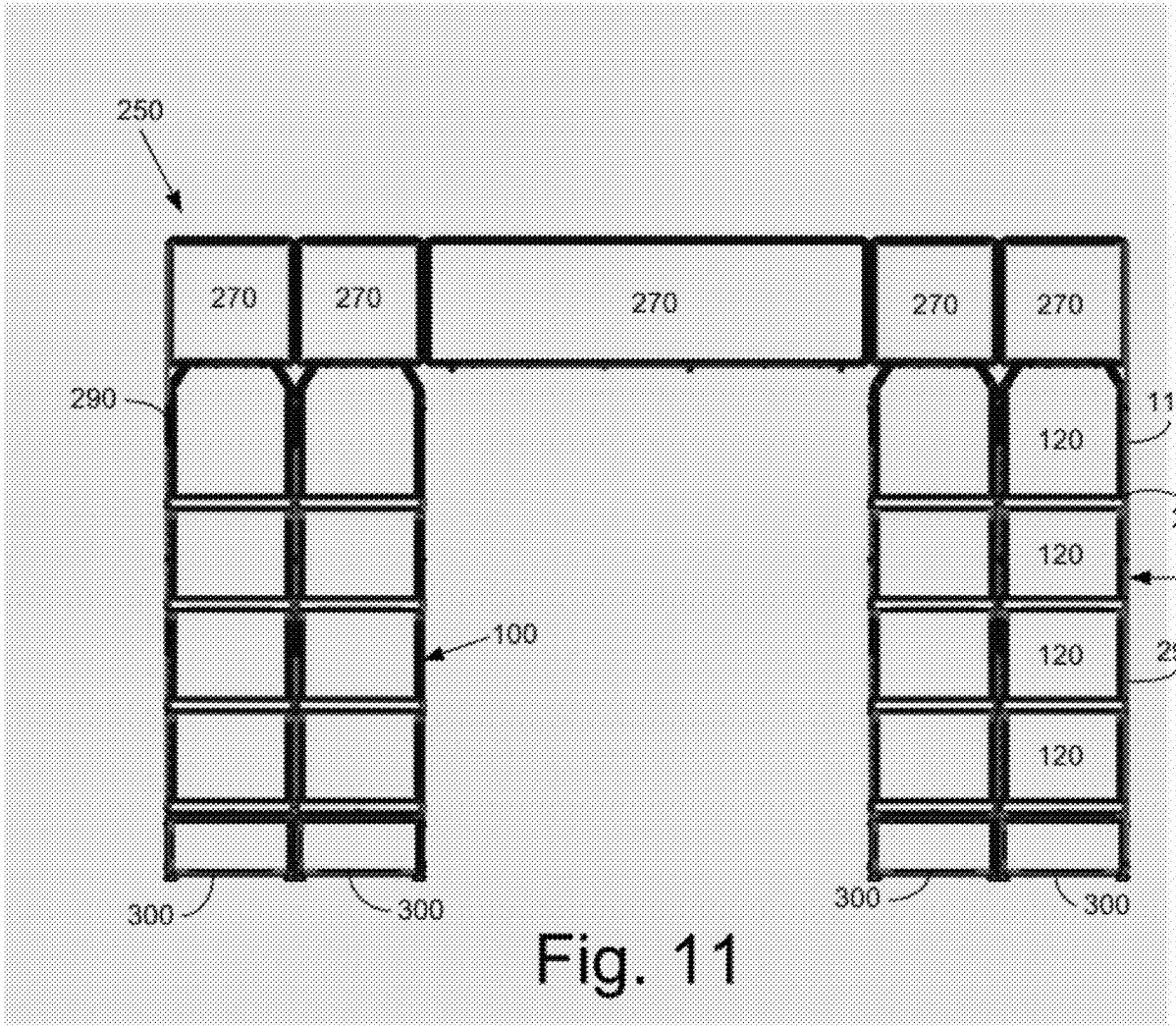
FIG. 11 is a front plan view of the modular product display system of FIG. 10.
Figure 13:
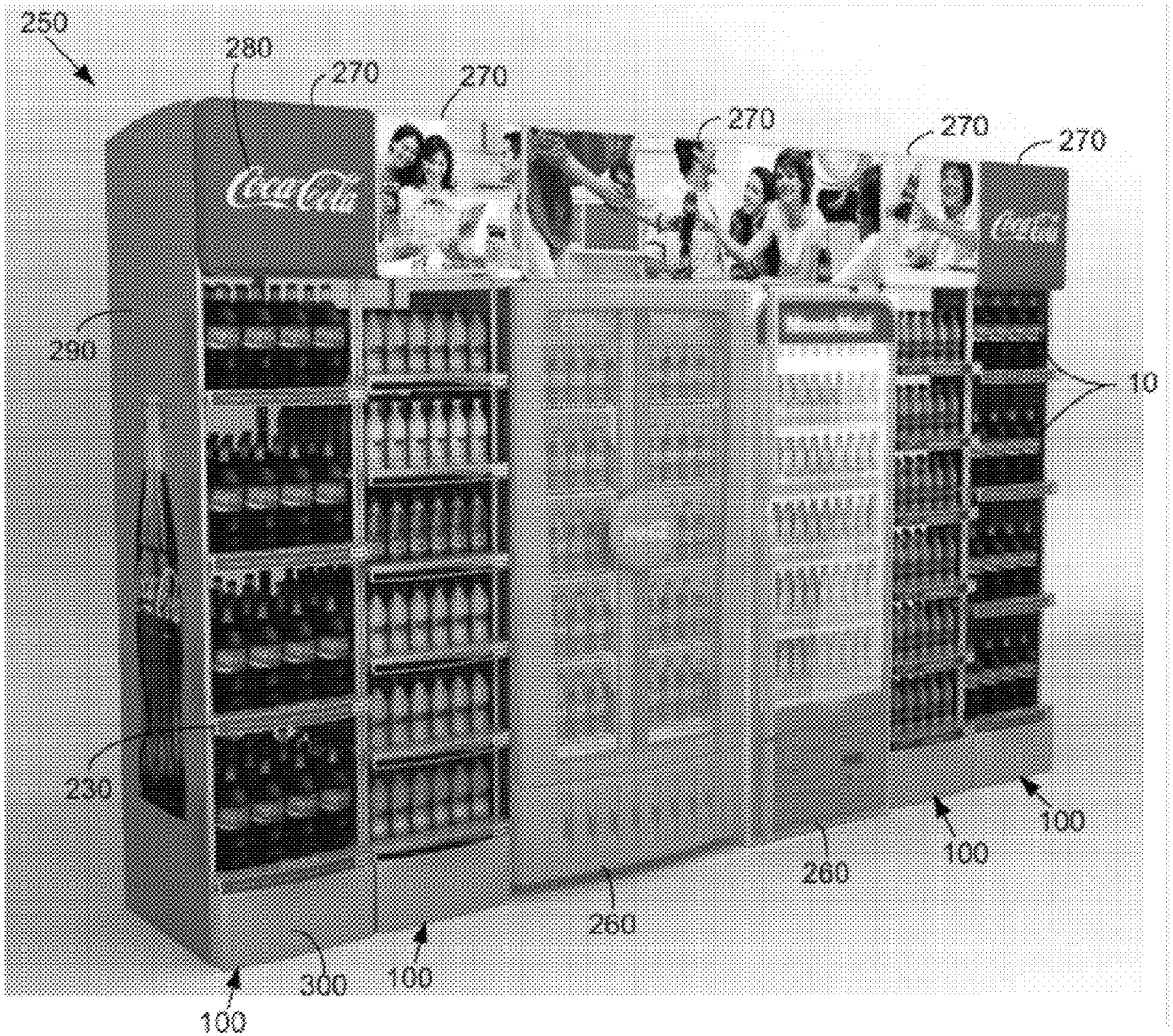
FIG. 13 is a perspective view of an example of a modular product display system.

As is shown in FIGS. 7-9, each shelf 120 may include a pair of front locking sections 180. Each front locking section 180 may include a tapered cutout 190 shaped such that one of the support members 110 may be guided into and then fit securely therein in a saddle like configuration. The tapered cutout 190 thus may be shaped and sized to accommodate a given support member 110.

The front locking section 180 also may include a support bracket 200 extending into the tapered cutout 190. Each support bracket 200 may include a base 205 extending to a number of L-shaped teeth or hooks 210. Part of the base 205 may be positioned within the shelf 120 and part of the base 205 and the hooks 210 may extend into the tapered cutout 190. The hooks 210 may be sized to fit within the slots 140 of the support members 110 so as to support the shelf 120 thereon. Although FIG. 7 shows the use of two (2) hooks 210, any number of the hooks 210 may be used herein. Other types and configurations of locking mechanisms also may be used herein.

The use of the front locking sections 180 with the tapered cutout 190 also defines a front panel 220 on each shelf 120. The front panel 220 may extend the length of the shelf 120 and may extend across the support members 110 as well. Messaging indicia of any type may be positioned thereon as will be described in more detail below. The front panel 220 may have any size or shape.

The shelf 120 also may include a rear locking section 230. The rear locking section 230 also may include a support bracket 200 with the base 205 and the hooks 210 extending therefrom. The rear locking section 230 locks the shelf 120 into place along the support members 110 in the rear. Although not shown, the rear locking section 230 also may include a tapered cutout 190 if desired. Other types of locking mechanisms may be used herein.

Although the terms front locking section 180 and rear locking section 230 have been used herein, the terms front and rear are relative. The locking sections 180, 230 may be positioned in any direction or order.

In use, each shelf 120 may be positioned about the support members 110. Specifically, the front support members 110 may be positioned within the tapered cutout 190 of the front locking sections 180 of each shelf 120. The hooks 210 of the support brackets 200 may be positioned within the desired slots 140. Likewise, the hooks 210 and the support brackets 200 of the rear locking sections 230 also may be positioned within the rear support members 110. Any number of the shelves 120 may be used. Likewise, each shelf 120 may be removed from the particular slots 140 in the support members 110 and repositioned into different slots 140 so as to accommodate products 10 of varying heights and configurations.

The use of the tapered cutout 190 about the front locking sections 180 also ensures that the modular racking system 100 as a whole becomes more rigid as more load is placed on each shelf 120. The tapered cutout 190 surrounding the support members 110 minimizes the flexing of the modular racking system 100 as more of a load is applied thereto. Specifically, the hooks 210 draw the support members 110 into the saddle-like shape of the tapered cutout 190 by the application of downward force caused by a load in form of the products 10 and the like being placed on the shelves 120. The use of the tapered cutout 190 and the front locking system 180 eliminates the need for complex locking mechanisms while providing adequate rigidity when a load is applied to the shelves 120 herein. The modular racking system 100 thus provides the ease of use often found with modular wall band system but in a free standing device.

FIGS. 10-13 show a product display system 250 as may be described herein. The product display system 250 may include any number of the modular racking systems 100. The modular racking systems 100 may be positioned in any desired configuration. For example, a number of the modular racking systems 100 with products 10 therein at an ambient temperature may be positioned about one or more coolers 260 with products 10 therein at a chilled temperature. One or more advertising panels 270 may be positioned about each of the modular racking systems 100 and elsewhere. Each of the advertising panels 270 may have messaging indicia 280 thereon. The advertising panels 270 may have any desired size or shape. The messaging indicia 280 may take the form of print advertising, electrical systems or messaging, or any type of media may be used herein. Multiple types of media also may be used. Sound also may be incorporated herein.

The product display system 250 also may include a number of side panels 290 for use with the outer modular racking systems 100 and a number of footer panels 300 for the bottom of each of the modular racking system 100. The messaging indicia 280 thus may be positioned about the advertising panels 270, the side panels 290, the footers 300, and/or the front panel 220 of each shelf 120. Other configurations and other types of advertising locations may be used herein.

The product display system 250 thus provides flexible and easily changeable and expandable retail space with the ability to promote the products therein in multiple locations and mediums. Moreover, the use of the modular racking systems 100 therein provides flexibility in terms of accommodating products 10 of differing sizes and shapes.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A modular racking system for use with a number of products, comprising:

a plurality of support members comprising a plurality of slots therein;

a plurality of shelves each comprising opposing lateral sides that define a length therebetween;

the plurality of shelves comprising a plurality of locking sections with a tapered cutout that at least partially forms a saddle portion therein along the lateral side of the plurality of shelves, wherein the tapered cutout is sized for one of the plurality of support members to be guided into and fit securely in the saddle portion, and wherein the plurality of locking sections define a front panel that extends the length of the plurality of shelves across the plurality of support members; and a support bracket comprising a base having one or more hooks extending therefrom, wherein the hooks are configured to mate with the plurality of slots of the support member and draw the support member into the saddle portion of the tapered cutout when a downward force is applied to at least one of the plurality of shelves, and wherein at least a portion of the base of the support bracket is positioned within the shelf and at least a portion of the base and hooks of the support bracket extend into the saddle portion of the tapered cutout.

2. The modular racking system of claim 1, wherein the plurality of support members comprises extended upright tubing.

3. The modular racking system of claim 1, wherein the plurality of support members comprises a plurality of adjustable feet.

4. The modular racking system of claim 1, wherein the plurality of locking sections comprises a plurality of front locking sections.

5. The modular racking system of claim 1, wherein the plurality of locking sections comprises a plurality of rear locking sections.

6. The modular racking system of claim 1, wherein the plurality of locking sections comprises a support bracket extending into the tapered cutout.

7. The modular racking system of claim 6, wherein the support bracket comprises a plurality of teeth.

8. The modular racking system of claim 1, wherein the front panel comprises messaging indicia thereon.

9. The modular racking system of claim 1, further comprising one or more advertising panels positioned thereon.

10. The modular racking system of claim 1, further comprising:

a plurality of modular racking systems formed by the plurality of support members and the plurality of shelves; and a plurality of advertising panels positioned about the plurality of modular racking systems.

11. The modular racking system of claim 10, further comprising one or more coolers positioned adjacent to the plurality of modular racking systems.

12. The modular racking system of claim 10, wherein the plurality of advertising panels comprises messaging indicia thereon.

13. The modular racking system of claim 10, further comprising a plurality of front panels, a plurality of side panels, and a plurality of footer panels with messaging indicia thereon.

14. The modular racking system of claim, wherein the one or more hooks comprise one or more downward facing L-shaped teeth.

* * * * *